US012553691B2

(12) United States Patent
Tervola

(10) Patent No.: US 12,553,691 B2
(45) Date of Patent: Feb. 17, 2026

(54) COMPACT BALLISTIC SHIELD WITH OFFSET SPACED COMPONENTS FOR IMPROVED PERFORMANCE

(71) Applicant: Timo Olavi Tervola, Jupiter, FL (US)

(72) Inventor: Timo Olavi Tervola, Jupiter, FL (US)

( * ) Notice: Subject to any disclaimer, the term of this patent is extended or adjusted under 35 U.S.C. 154(b) by 0 days.

(21) Appl. No.: 18/198,567

(22) Filed: May 17, 2023

(65) Prior Publication Data

US 2023/0366658 A1 Nov. 16, 2023

Related U.S. Application Data

(60) Provisional application No. 63/342,569, filed on May 16, 2022.

(51) Int. Cl.
*F41H 5/08* (2006.01)

(52) U.S. Cl.
CPC ..... *F41H 5/08* (2013.01)

(58) Field of Classification Search
CPC ..... F41H 5/08; F41H 5/13
See application file for complete search history.

(56) References Cited

U.S. PATENT DOCUMENTS 1,895,197 A * 1/1933 Martinson ..... F41H 5/08 2/2.5
2,020,702 A * 11/1935 Russell ..... F41H 5/08 2/2.5
3,745,938 A * 7/1973 Hathaway ..... F41H 5/08 2/2.5
6,807,890 B1 * 10/2004 Fuqua ..... F41H 5/08 89/36.02
8,015,910 B1 * 9/2011 Fuqua ..... F41H 5/14 89/36.01
8,210,088 B1 * 7/2012 Keyfauver ..... F41H 5/08 89/918
8,215,223 B2 * 7/2012 Lucuta ..... F41H 5/0414 89/36.02
8,418,595 B1 * 4/2013 Saucedo ..... F41H 5/08 89/36.01
10,267,601 B1 * 4/2019 Beck ..... F41H 5/14
10,794,665 B1 * 10/2020 Taylor ..... B32B 5/18
(Continued)

OTHER PUBLICATIONS

Defense Systems Information Analysis Center (DSIAC), Characterization of Composite Spaced Armor Performance, Summer 2020: vol. 7, No. 3; https://dsiac.org/webinars/characterization-of-composite-spaced-armor-performance/ (Year: 2020).*

*Primary Examiner* — Joshua E Freeman
(74) *Attorney, Agent, or Firm* — Ingram IP Law, P.A.

(57) ABSTRACT

A multi-piece ballistic shield is provided with a first shield having an outward face exposed to projectiles and an opposing inward face. The first shield having a first offset layer mechanically coupled to a first section of the outward face of the first shield and a second offset layer mechanically coupled to a second section of the outward face of the first shield. The multi-piece ballistic shield further includes a second shield having an outward face exposed to projectiles and an opposing inward face. The second shield is detachably coupled to the first shield such that the second offset layer overlaps a seam formed between the first and second shields. The multi-piece ballistic shield includes a harness coupled to a fastener to support a weight of the multi-piece ballistic shield.

20 Claims, 14 Drawing Sheets

(56) References Cited

U.S. PATENT DOCUMENTS

| | | | | |
|---|---|---|---|---|
| 10,955,223 | B1 * | 3/2021 | Guyette | F41H 5/013 |
| 10,976,138 | B2 * | 4/2021 | Tervola | F41H 5/08 |
| 2007/0283477 | A1 * | 12/2007 | Dovner | F41H 9/10 2/2.5 |
| 2012/0174768 | A1 * | 7/2012 | Spransy | F41H 5/013 89/929 |
| 2012/0186432 | A1 * | 7/2012 | St. Claire | F41H 5/023 89/914 |
| 2013/0284003 | A1 * | 10/2013 | Dodworth | F41H 5/0428 428/116 |
| 2014/0238225 | A1 * | 8/2014 | Mickiewicz | F41H 5/26 89/36.07 |
| 2016/0054101 | A1 * | 2/2016 | Rashad | F41H 5/08 109/23 |
| 2019/0390941 | A1 * | 12/2019 | Beck | B32B 7/12 |
| 2020/0025525 | A1 * | 1/2020 | Spransy | F41H 5/08 |
| 2020/0064106 | A1 * | 2/2020 | Tervola | F41H 5/08 |
| 2021/0215459 | A1 * | 7/2021 | Chen | F41H 5/013 |
| 2022/0408905 | A1 * | 12/2022 | Bustos | A45F 3/02 |
| 2022/0412690 | A1 * | 12/2022 | Daniel | F41H 5/08 |

* cited by examiner

COMPACT BALLISTIC SHIELD WITH OFFSET SPACED COMPONENTS FOR IMPROVED PERFORMANCE

CROSS-REFERENCE TO RELATED APPLICATION

This application claims priority to U.S. Provisional Application Ser. No. 63/342,569 filed on May 16, 2022, the complete disclosure of which is incorporated herein by reference in its entirety.

FIELD OF THE TECHNOLOGY

The present technology broadly relates to ballistic shields, more specifically to multi-ply ballistic shields, and still more specifically to compact, multi-layer and multi-ply ballistic shields.

BACKGROUND OF THE TECHNOLOGY

Law enforcement, military, and/or other security forces employ ballistic shields to protect themselves during dangerous situations that may include armed conflict or physical altercations. For example, ballistic shields may be employed to defeat active shooters, serve high-risk warrants, perform riot control, or the like. Ballistic shields may prevent death or injury that may result from being hit with projectiles such as bullets, rocks, bricks, bats, sticks, arrows, or the like.

BRIEF DESCRIPTION OF THE FIGURES

The technology can be more fully understood by reading the following detailed description together with the accompanying drawings, in which like reference indicators are used to designate like elements. The drawings illustrate several examples of the technology. It should be understood, however, that the technology is not limited to the precise arrangements and configurations shown. In the drawings.

DETAILED DESCRIPTION OF THE TECHNOLOGY

Figure 1:
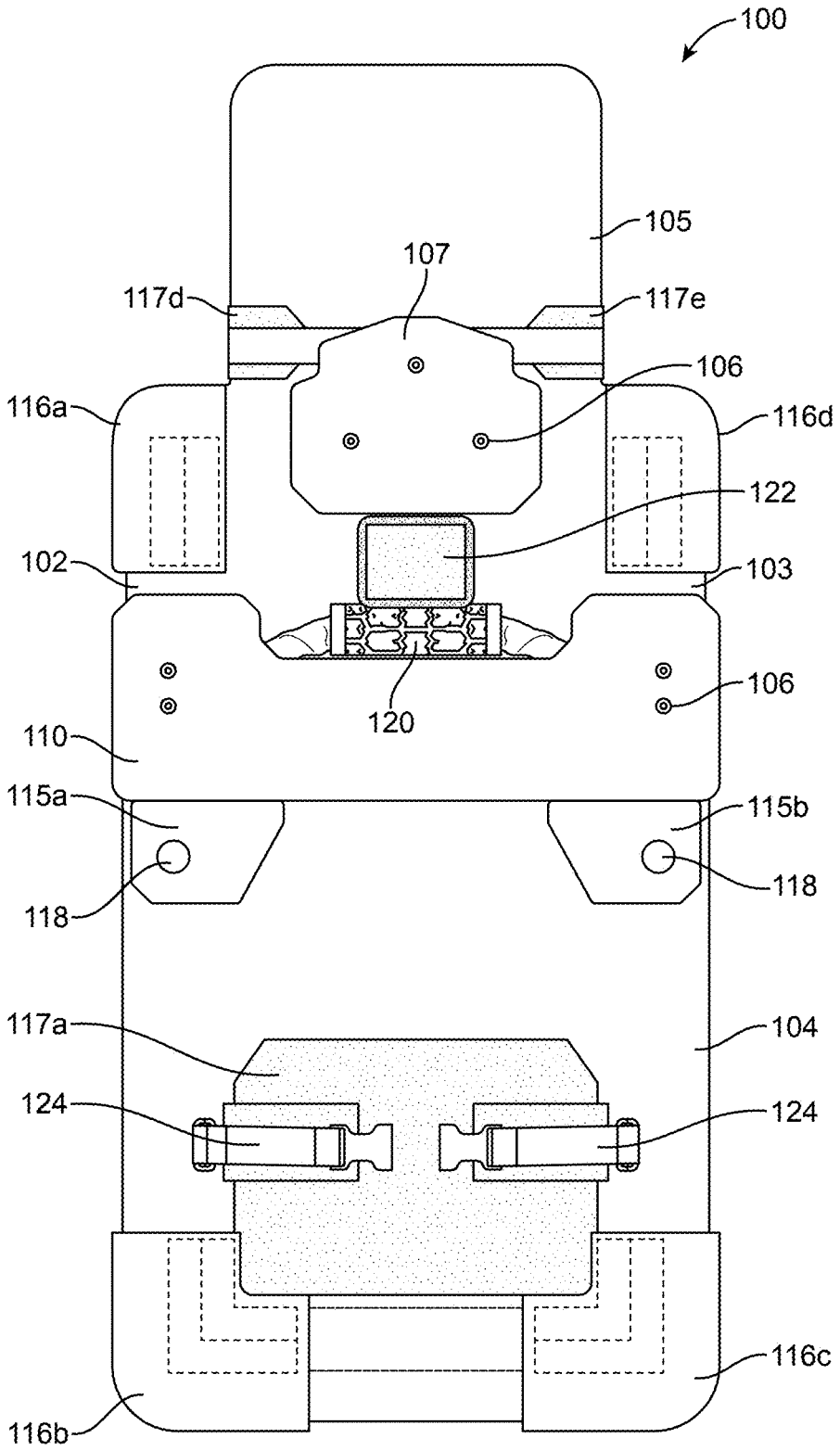
FIG. 1 illustrates a multi-piece ballistic shield depicted in front view with first and second shield portions secured together according to one example of the technology.

It will be readily understood by persons skilled in the art that the present disclosure has broad utility and application. In addition to the specific examples described herein, one of ordinary skill in the art will appreciate that this disclosure supports various adaptations, variations, modifications, and equivalent arrangements.

It will be appreciated that for simplicity and clarity of illustration, where appropriate, reference numerals may be repeated among the different figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, methods, procedures, and components have not been described in detail so as not to obscure the related relevant feature being described. Also, the description is not to be considered as limiting the scope of the examples described herein. The drawings are not necessarily to scale and the proportions of certain parts may have been exaggerated to better illustrate details and features of the present disclosure. Those skilled in the art with access to the teachings provided herein will recognize additional modifications, applications, and examples within the scope thereof and additional fields in which the technology would be of significant utility.

Unless defined otherwise, technical terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and means either, any, several, or all of the listed items. The terms "comprising," "including," and "having" are used interchangeably in this disclosure. The terms "comprising," "including," and "having" mean to include, but are not necessarily limited to the things so described.

The terms "connected" and "coupled" can be such that the objects are permanently connected or releasably connected.

The term "substantially" is defined to be essentially conforming to the thing that it "substantially" modifies, such that the thing need not be exact. For example, substantially 2 inches (2") means that the dimension may include a slight variation.

According to one example, the multi-piece ballistic shield may be constructed from high-strength fibers, epoxy, plastic materials, or the like. According to one example, the multi-piece ballistic shield may be constructed from several layers of high-strength fibers that are mechanically or chemically bonded together. For example, the multi-piece ballistic shield may be constructed from several layers of high strength fibers that are laminated together. According to one example, multiple layers of soft pliable polyethylene film may be formed into a rigid composite ballistic shield or armor panel under extreme pressure and heat. According to one example, a multi-layer ballistic shield may improve ballistic strength based on the existence of molecular or mechanical bonds between individual layers. According to one example, impacting or penetrating projectiles may break molecular bonds when traveling between individual layers. Additionally, or alternatively, the impacting or penetrating projectiles may break mechanical bonds when traveling between individual layers. According to one example, the act of breaking molecular or mechanical bonds between individual layers causes the impacting or penetrating projectiles to dissipate kinetic energy, thereby slowing down.

During a first phase of projectile entry into a ballistic shield, the projectile nose shears or tears several surface layers of the high-strength fibers upon impact, puncturing holes therethrough. According to one example, a high velocity projectile with a small leading surface area causes shearing and puncturing of several layers of high-strength fibers. For example, the penetrating projectile generates frictional forces between the projectile nose and the high-strength fibers that in turn generate thermal energy sufficient to melt or shear the high-strength fibers, forming holes therethrough. According to one example, the ballistic shield is less effective at stopping projectiles during this first phase when layers of the ballistic shield are pierced, rather than separated or delaminated. According to one example, the leading surface area of the armor increases as the projectile nose blunts under the forces of the first phase of projectile entry. This causes the armor to generally deform. For example, the impact forces may blunt the projectile or strip the jacket off the projectile. When the projectile deforms or blunts by a sufficient amount, the high-strength armor fibers may stop shearing. As a result, the projectile may stop shearing or forming holes through the layers of the ballistic shield. According to one example, the first phase of projectile entry may cause minimal layer delamination.

According to one example, a second phase of projectile penetration into the ballistic shield begins when the projectile is sufficiently blunt with sufficient leading surface area to delaminate underlying layers. According to one example, the impacting or penetrating projectiles impart separation forces that delaminate underlying layers. According to one example, the delaminating layers may be physically displaced. For example, the delaminating layers may be physically displaced in lateral or rearward directions, away from a penetrating face of the multi-layer ballistic shield. According to one example, the physically displaced layers may capture the penetrating projectiles within the multi-piece ballistic shield. In other words, the underlying layers form the equivalent of a catcher's mitt to stop the penetrating projectile from advancing. Stated differently, the penetrating projectiles may be prevented from traveling through and exiting the multi-piece ballistic shield.

FIG. 1 illustrates the multi-piece ballistic shield 100 according to one example of the technology. According to one example, the multi-piece ballistic shield 100 includes a first shield portion 102 and a second shield portion 104, which may be folded onto each other or separated from each other. The foldable shield portions provide a compact multi-piece ballistic shield 100 that may be transported in standard issued military backpacks or the like. The separable shield portions allow two users to employ a single multi-piece ballistic shield 100 during combat situations, with one user using the first shield portion 102 and another user using the second shield portion 104.

Figure 9:
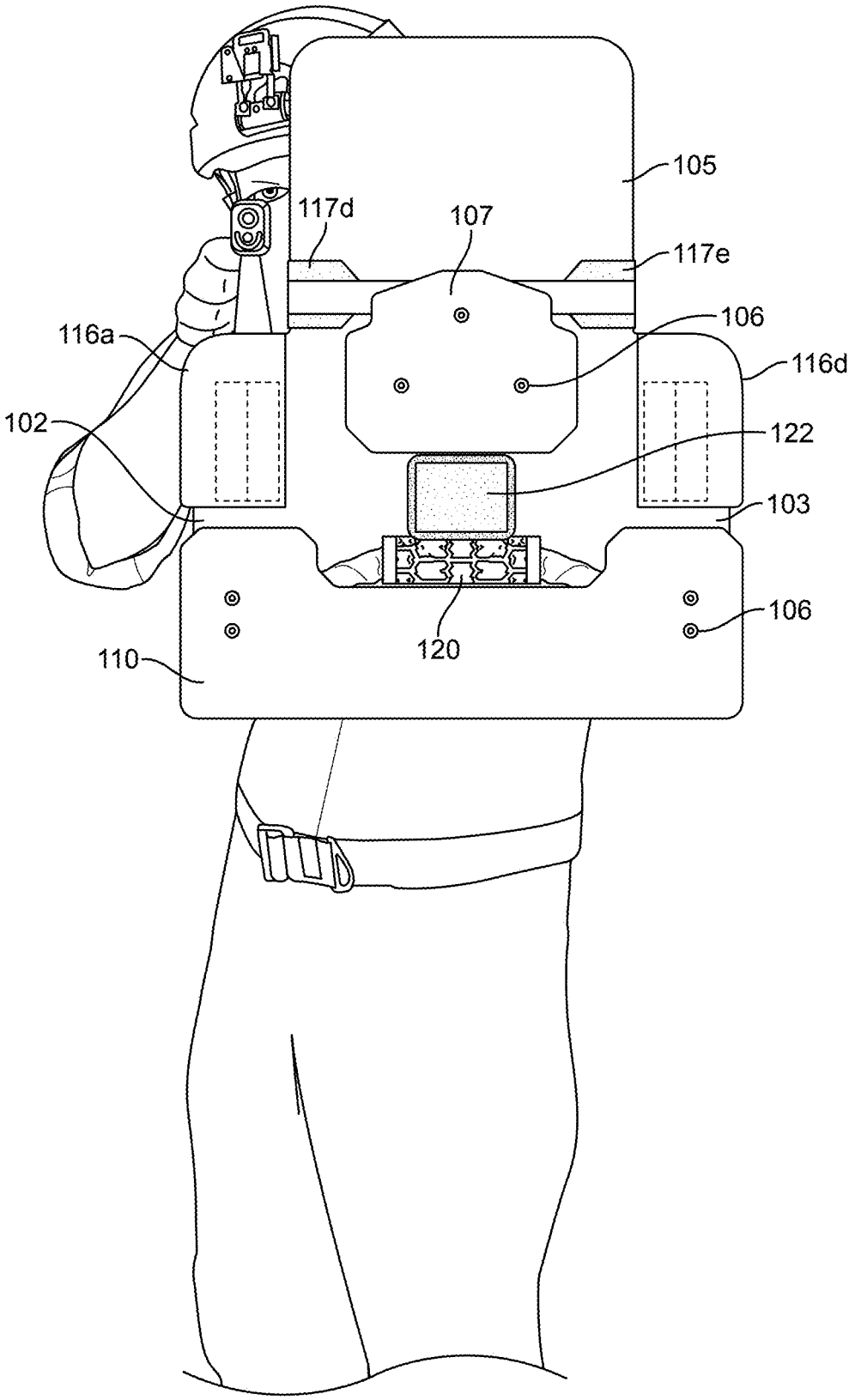
FIG. 9 illustrates a front view of the second shield portion in use according to one example of the technology.

According to one example, the first shield portion 102 may be provided at an upper portion of the multi-piece ballistic shield 100. The first shield portion 102 may be shaped or contoured to correspond to a human upper body such as chest and head. For example, the first shield portion 102 may include a larger rectangular section 103 that may correspond to a human torso and a projecting smaller rectangular section 105 that may correspond to a human head and neck. With reference to FIG. 9, the larger rectangular section 103 may be dimensioned to protect a human upper torso. Furthermore, the smaller rectangular section 105 may be dimensioned to protect a human head and neck. According to one example, the first shield portion 102 may be of unitary construction. In other words, the first shield portion 102 may be of single piece construction. According to one example, FIG. 1 illustrates a front view or an outward face of the multi-piece ballistic shield 100. According to one example, the outward face receives a projectile and is thus termed a penetrating face of the multi-piece ballistic shield 100.

According to one example, the first shield portion 102 may include an upper second layer 107 that is mechanically coupled to a transition area between the larger rectangular section 103 and the smaller rectangular section 105. For example, the upper second layer 107 may be mechanically coupled to the larger rectangular section 103 and the smaller rectangular section 105 using fasteners 106 such as screws, bolts, rivets, or the like. According to one example, an air gap may be provided between the first shield portion 102 and the upper second layer 107. According to one example, the air gap may provide an offset between the first shield portion 102 and the upper second layer 107. For example, the upper second layer 107 may be offset or spaced away from the first shield portion 102 via the air gap. Alternatively, the air gap may be eliminated and the upper second layer 107 may directly contact or abut the first shield portion 102. According to one example, the upper second layer 107 is positioned to protect an upper body or torso area of a user, such as the chest, face, and neck. In other words, the upper second layer 107 provides additional protection to vital areas of a human body as compared to single layer shields. Furthermore, it is contemplated that the user may wear a ballistic helmet or other redundant body armor to protect the head and torso while carrying the multi-piece ballistic shield 100.

According to one example, the upper second layer 107 may completely stop a projectile, leaving the first shield portion 102 unaffected. According to another example, a projectile may penetrate through the upper second layer 107 and may enter the air gap with less mass and reduced velocity prior to impacting the first shield portion 102. In this case, the upper second layer 107 offers several benefits to the underlying first shield portion 102, including a reduced threat of defeating the first shield portion 102 and improved shot spacing performance. With respect to the reduced threat of defeating the first shield portion 102, the reduced mass and velocity of projectiles that may exit the upper second layer 107 may prevent the first shield portion 102 from experiencing the first phase of projectile entry.

According to one example, shot spacing refers to a physical distance between adjacent projectile impacts. If an area of a shield is compromised due to the first phase of projectile entry or the second phase of projectile penetration, a greater shot spacing is needed to stop a subsequent projectile of equivalent threat. With respect to improving shot spacing performance, the upper second layer 107 may eliminate or significantly reduce exposure of the first shield portion 102 to the first phase of projectile entry. Accordingly, the high-strength fibers of the first shield portion 102 may avoid being torn or sheared due to the mechanical or thermal processes discussed above. Still further, the upper second layer 107 may eliminate or significantly reduce exposure of the first shield portion 102 to the second phase of projectile penetration into the ballistic shield as discussed above. With the upper second layer 107 eliminating or significantly reducing exposure of the first shield portion 102 to the first phase of projectile entry or the second phase of projectile penetration, the shield design described herein may allow closer shot spacing for subsequent rounds as compared to a ballistic shield without a second or additional overlapping layer.

According to one example, an air gap between shield components may prevent a projectile or portion of a projectile from penetrating the first shield portion 102. For example, if a projectile includes a hardened element within a jacket, the upper second layer 107 may strip the jacket. However, a trajectory of the hardened element may be minimally disturbed, and the hardened element may not deform while passing through the upper second layer 107. According to one example, the upper second layer 107 may enable the hardened element to yaw or tumble upon entering the air gap, prior to impacting the first shield portion 102. This change in direction or orientation of the hardened element within the air gap may reduce a threat of the hardened element to the first shield portion 102. In other words, the air gap may enable destabilization of a projectile or portion of a projectile prior to impacting the first shield portion 102. Still further, the air gap may receive deformed layers therein that originate from the upper second layer 107 such that the deformed layers do not contact the first shield portion 102. According to one example, providing an air gap between the first shield portion 102 and the upper second layer 107 may enable manufacturing of the shield components with a reduced number of layers as compared to a shield without an air gap. This may result in a shield having reduced thickness and weight as compared to a shield without an air gap. One of ordinary skill in the art will readily appreciate that the first shield portion 102 and the upper second layer 107 may be mechanically coupled without an air gap therebetween. However, omitting the air gap between the first shield portion 102 and the upper second layer 107 may require the shield components to be manufactured with increased thickness to provide equivalent performance to a shield having an air gap.

According to one example, the first shield portion 102 may include a lower second layer 110 that is mechanically coupled to the larger rectangular section 103. For example, the lower second layer 110 may be mechanically coupled to the larger rectangular section 103 using fasteners 106 such as screws, bolts, rivets, or the like. According to one example, an air gap may be provided between the first shield portion 102 and the lower second layer 110. According to one example, the air gap may provide an offset between the first shield portion 102 and the lower second layer 110. For example, the lower second layer 110 may be offset or spaced away from the first shield portion 102 via the air gap. Alternatively, the air gap may be eliminated and the lower second layer 110 may directly contact or abut the first shield portion 102. According to one example, the lower second layer 110 is positioned to protect a user's chest area, such as the heart, lungs, or other vital organs.

Figure 2:
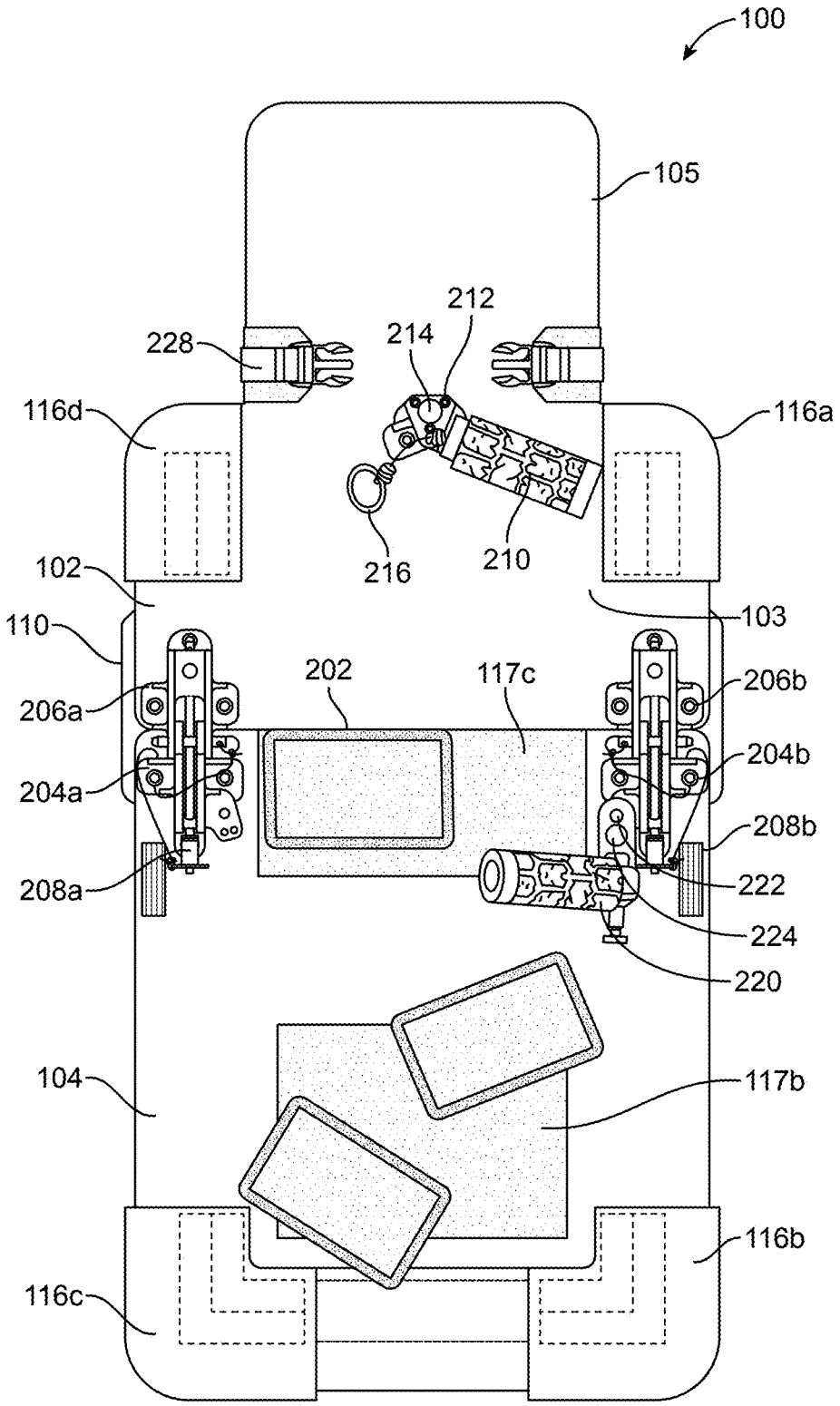
FIG. 2 illustrates the multi-piece ballistic shield depicted in back view with the first and second shields portions secured together according to one example of the technology.

According to one example, the lower second layer 110 may be positioned to cover a seam 202 formed at joining edges between the first shield portion 102 and the second shield portion 104. According to one example, the seam 202 is formed when the first shield portion 102 is mechanically coupled to the second shield portion 104. FIG. 2 illustrates the seam 202 at the abutment position of the first shield portion 102 and the second shield portion 104 according to one example. Without the lower second layer 110 in place, the seam 202 provides an entry point to a projectile that impacts the multi-piece ballistic shield 100 at the seam 202. Accordingly, the lower second layer 110 is provided over the seam 202 to prevent a projectile from directly impacting the seam 202 and breaching the multi-piece ballistic shield 100. According to one example, the lower second layer 110 may completely stop a projectile from breaching the multi-piece ballistic shield 100.

According to another example, a projectile may penetrate the lower second layer 110 and may enter the air gap with less mass and reduced velocity prior to impacting the seam 202 formed between the first shield portion 102 and the second shield portion 104. In this case, the lower second layer 110 offers several benefits to the underlying shield components, including a reduced threat of defeating the multi-piece ballistic shield 100 and improved shot spacing performance. With respect to the reduced threat of defeating the multi-piece ballistic shield 100, the reduced mass and velocity of projectiles that may exit the lower second layer 110 may prevent the first shield portion 102 and the second shield portion 104 from experiencing the first phase of projectile entry. Furthermore, the lower second layer 110 may prevent projectiles from passing through the seam 202.

With respect to improved shot spacing performance, the lower second layer 110 may eliminate or significantly reduce exposure of the first shield portion 102 and the second shield portion 104 to the first phase of projectile entry. Accordingly, the high-strength fibers of the first shield portion 102 and the second shield portion 104 may avoid being torn or sheared due to the mechanical or thermal processes discussed above. Still further, the lower second layer 110 may eliminate or significantly reduce exposure of the first shield portion 102 and the second shield portion 104 to the second phase of projectile penetration into the ballistic shield as discussed above. With the lower second layer 110 eliminating or significantly reducing exposure of the first shield portion 102 and the second shield portion 104 to the first phase of projectile entry or the second phase of projectile penetration, the shield design described herein may allow closer shot spacing for subsequent rounds as compared to a ballistic shield without a second or additional layer.

According to one example, the air gap beyond the lower second layer 110 may prevent a projectile or portion of a projectile from penetrating the seam 202, the first shield portion 102, or the second shield portion 104. For example, if a projectile includes a hardened element within a jacket, the lower second layer 110 may strip the jacket. However, a trajectory of the hardened element may be minimally disturbed, and the hardened element may not deform while passing through the lower second layer 110. According to one example, the lower second layer 110 may cause the hardened element to yaw or tumble upon entering the air gap, prior to impacting the seam 202, the first shield portion 102, or the second shield portion 104. This change in direction or orientation of the hardened element within the air gap may reduce a threat of the hardened element to the seam 202, the first shield portion 102, or the second shield portion 104. In other words, the air gap may enable destabilization of a projectile or portion of a projectile prior to impacting the seam 202, the first shield portion 102, or the second shield portion 104. Still further, the air gap may receive deformed layers therein that originate from lower second layer 110 such that the deformed layers do not contact the multi-piece ballistic shield 100. According to one example, providing an air gap between the first shield portion 102, the second shield portion 104, and the lower second layer 110 may enable manufacturing of the shield components with a reduced number of layers as compared to a shield without an air gap. This may result in a shield having reduced thickness and weight as compared to a shield without an air gap. One of ordinary skill in the art will readily appreciate that the first shield portion 102, the second shield portion 104, and the lower second layer 110 may be mechanically coupled without an air gap therebetween. However, omitting the air gap between the first shield portion 102, the second shield portion 104, and the lower second layer 110 may require the shield components to be manufactured with increased thickness to provide equivalent performance to a shield having an air gap.

Figure 3:
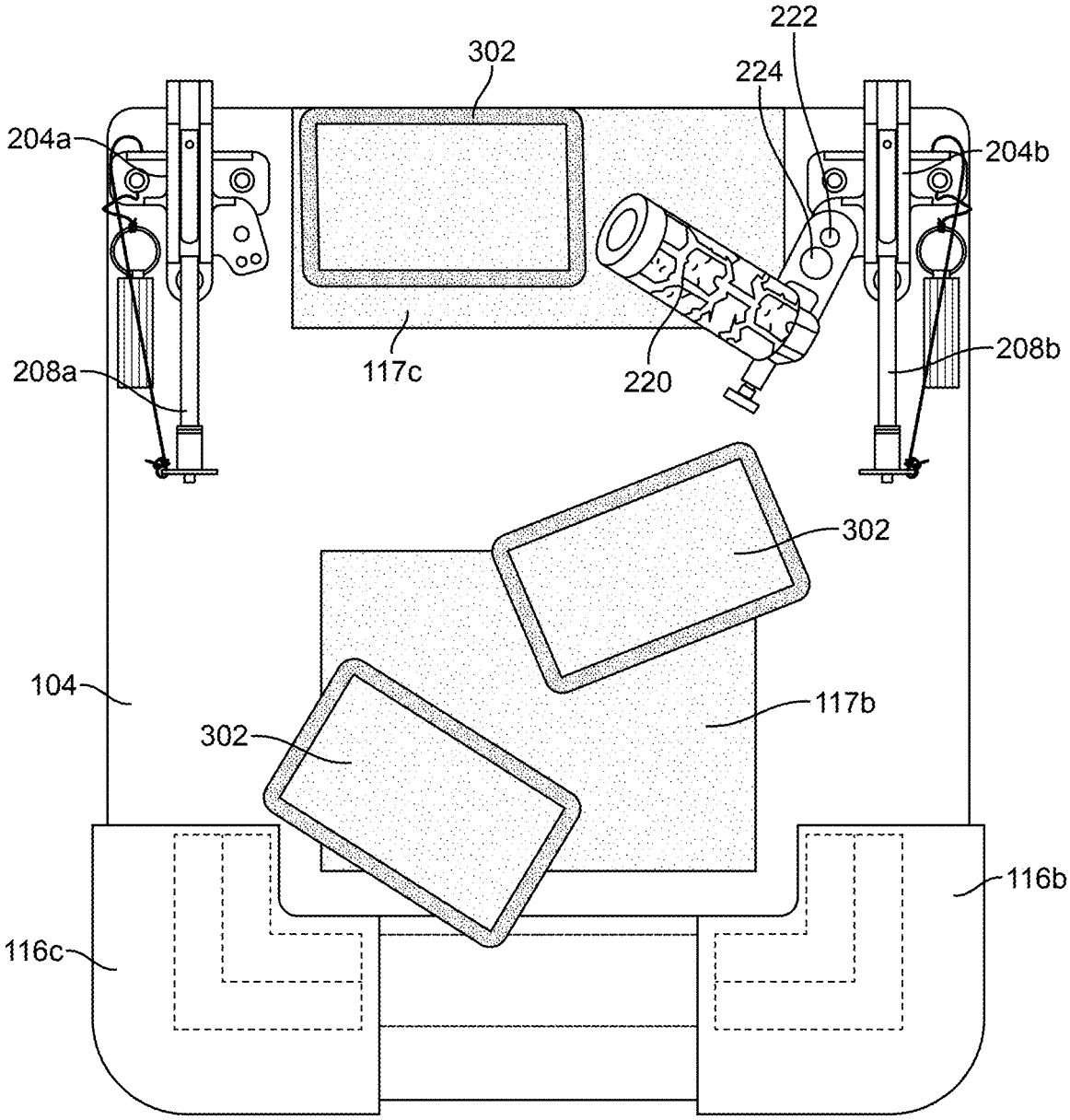
FIG. 3 illustrates a back view of the second shield portion of the multi-piece ballistic shield with a handle and fastening mechanisms that mechanically couple the first and second shields portions together according to one example of the technology.
Figure 4:
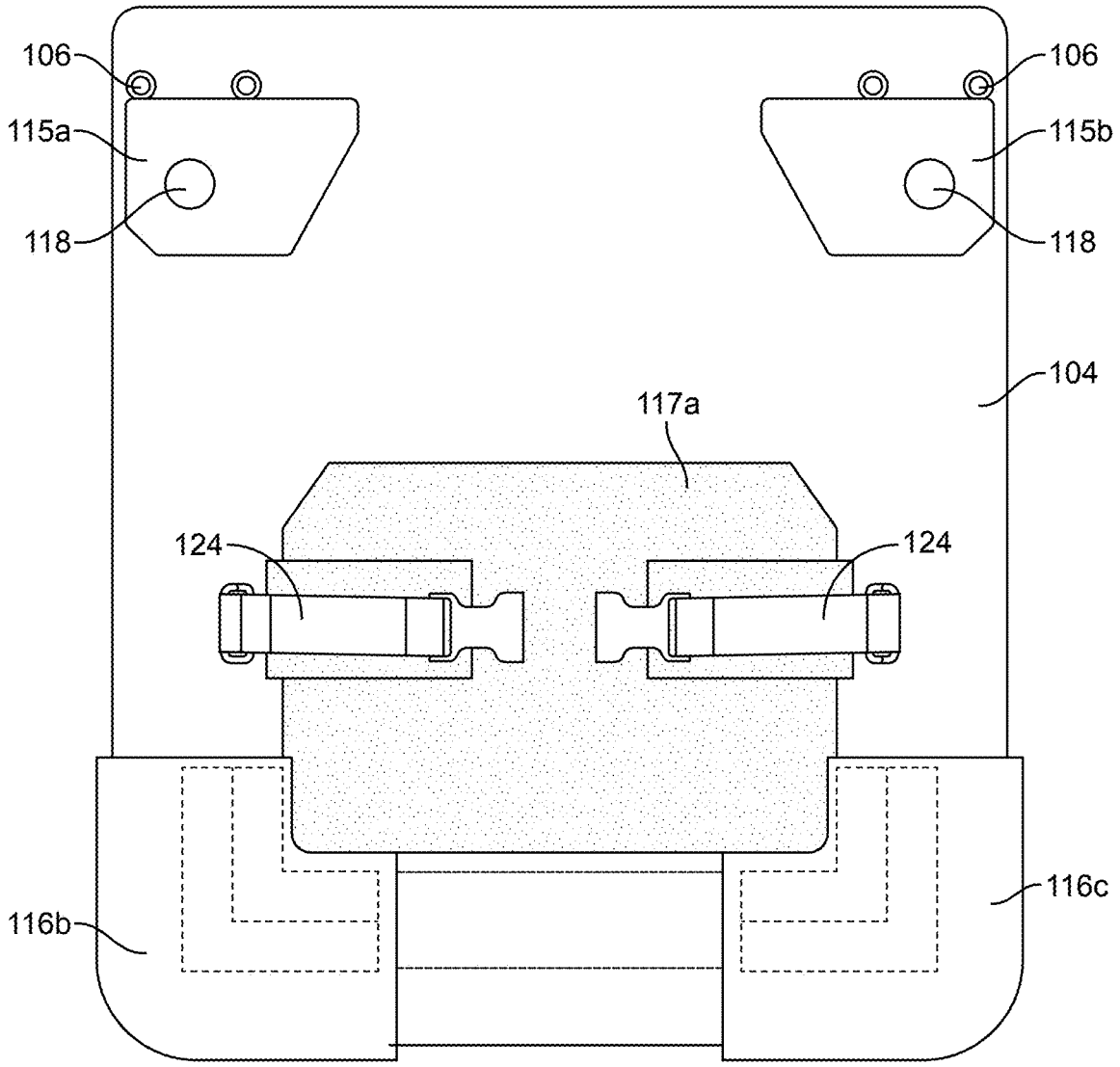
FIG. 4 illustrates a front view of the second shield portion of the multi-piece ballistic shield according to one example of the technology.

As illustrated in FIGS. 3 and 4, the second shield portion 104 may be shaped and dimensioned to substantially conform to a human torso. According to one example, the second shield portion 104 may be substantially rectangular shaped. According to one example, the second shield portion 104 may include fastening mechanisms 204*a*,204*b* that fixedly secure the second shield portion 104 and the first shield portion 102 to form a rigid multi-piece ballistic shield 100. According to one example, the fastening mechanisms 204*a*,204*b* provided on the second shield portion 104 may releasably engage corresponding anchors 206*a*,206*b* provided on the first shield portion 102. According to one example, the fastening mechanisms 204*a*,204*b* may include release mechanisms 208*a*,208*b* that actuate to release the first and second shield portions 102,104. FIG. 1 illustrates second layers 115*a*,115*b* provided in alignment with the fastening mechanisms 204*a*,204*b* that function similar to the upper second layer 107 and the lower second layer 110 described above. The second layers 115*a*,115*b* may be affixed to the second shield portion 104 using fasteners 118.

FIG. 1 further illustrates pads 116*a*-116*d* that may be applied to selected edges of the first and second shield portions 102,104. According to one example, the pads 116*a*-116*d* may protect selected edges of the multi-piece ballistic shield 100 from becoming damaged. Alternatively, or additionally, the pads 116*a*-116*d* may protect users of the multi-piece ballistic shield 100 from becoming injured. Furthermore, hook and loop patches 117*a*-117*e* may be provided at selected locations on the first and second shield portions 102,104. For example, the hook and loop patches 117*a*-117*e* may be provided on outward and inward faces of the first and second shield portions 102,104. FIG. 2 illustrates the multi-piece ballistic shield 100 with the fastening mechanisms 204*a*,204*b* provided on the second shield portion 104 to engage corresponding anchors 206*a*,206*b* provided on the first shield portion. According to one example, release mechanisms 208*a*,208*b* may be provided at the fastening mechanisms 204*a*,204*b* to engage and disengage corresponding anchors 206*a*,206*b*. According to one example, the fastening mechanism 204*a*,204*b* may be configured to allow the first and second shield portions 102,104 to fold onto each other for transport. One of ordinary skill in the art will readily appreciate that the fastening mechanism 204*a*,204*b* and the anchors 206*a*,206*b* may be interchangeably provided on either the first shield portion 102 or the second shield portion 104.

Figure 5:
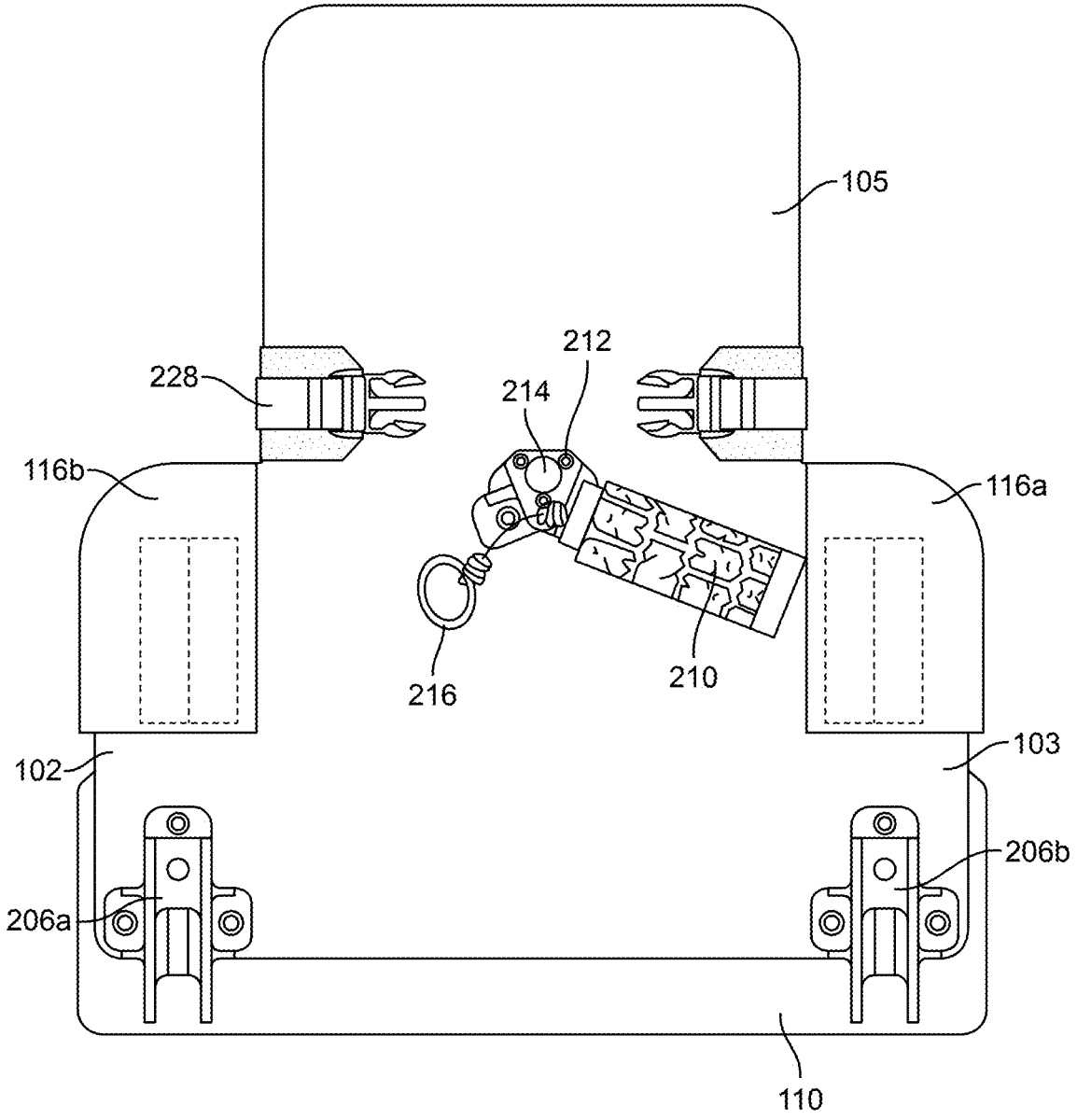
FIG. 5 illustrates a back view of the first shield portion of the multi-piece ballistic shield with a handle and anchors that mechanically couple to the fastening mechanism associated with the second shield portion according to one example of the technology.
Figure 6:
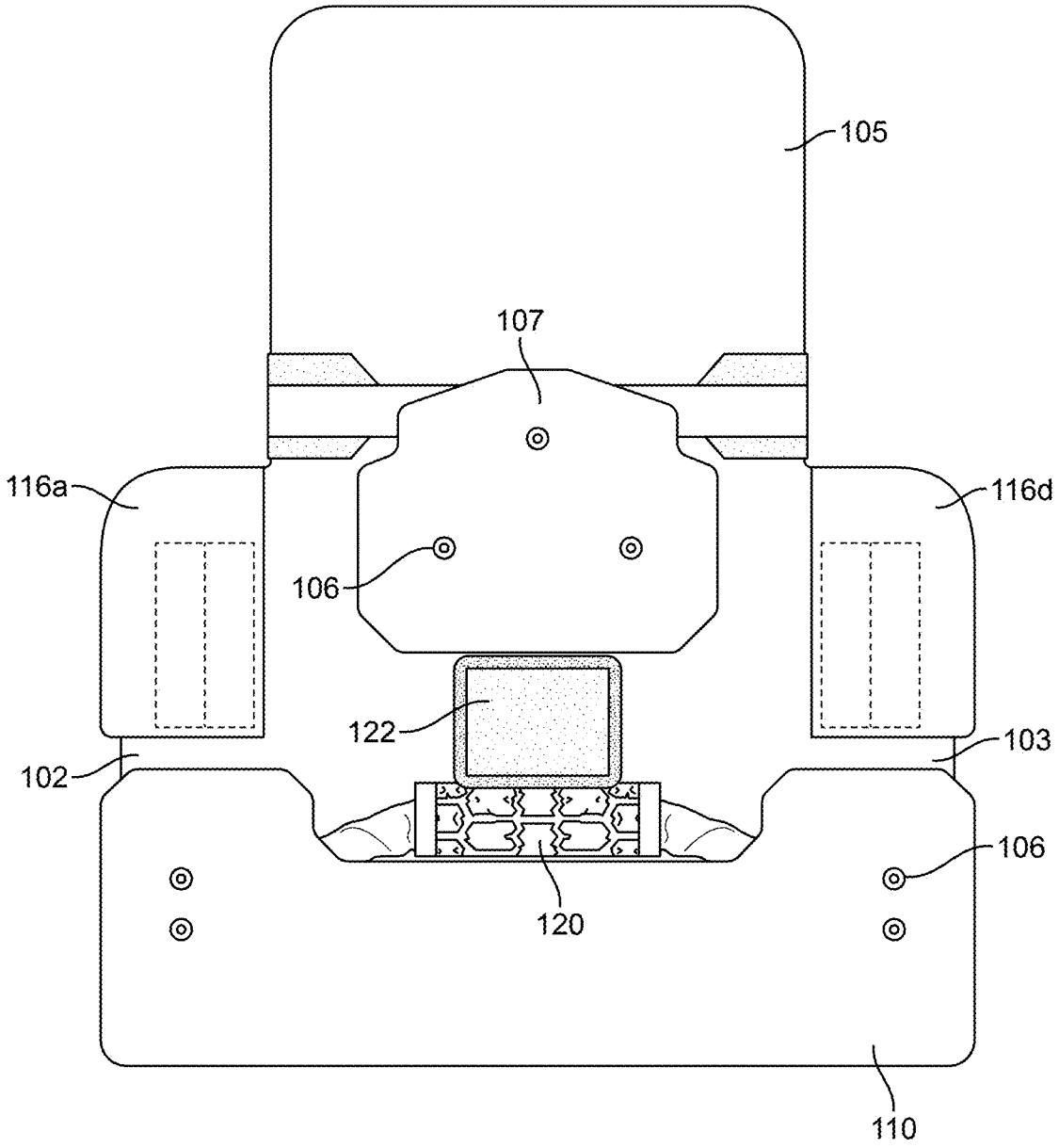
FIG. 6 illustrates a front view of the first shield portion of the multi-piece ballistic shield according to one example of the technology.

FIGS. 1 and 2 illustrate the first shield portion 102 and the second shield portion 104 affixed together according to one example of the technology. According to one example, the first shield portion 102 and the second shield portion 104 may be configured in an elongated arrangement with the first shield portion 102 positioned above the second shield portion 104 to provide an elongated multi-piece ballistic shield 100. According to one example, the elongated multi-piece ballistic shield 100 may be deployed in combat environments that offer room for movement. Alternatively, FIGS. 3 and 4 illustrate the second shield portion 104 by itself according to another example of the technology. Furthermore, FIGS. 5 and 6 illustrate the first shield portion 102 by itself according to yet another example of the technology. According to one example, the first shield portion 102 and the second shield portion 104 may be independently used to provide a compact multi-piece ballistic shield 100. According to one example, the compact multi-piece ballistic shield 100 may be employed in combat environments that offer reduced room for movement or during close quarter combat.

According to one example, the first shield portion 102 may include a handle 120, along with padded hook and loop patch 122. According to one example, the handle 120 may be employed by users to grip the first shield portion 102. For example, the handle 120 may be employed by users to grip the first shield portion 102 while separating the first shield portion 102 from the second shield portion 104. Furthermore, the handle 120 may be employed by users to grip the first shield portion 102 when it is carried alone as illustrated in FIG. 9. According to one example, the padded hook and loop patch 122 may be employed to cushion a contact point with a back of a user's hand when the handle 120 is gripped during use. According to one example, the padded hook and loop patch 122 may be employed to cushion a contact point with a user's forearm when the handle 120 is gripped during use.

FIGS. 1, 4 and 6 illustrate that the multi-piece ballistic shield 100 may include strategic sections having multi-stacked ballistic layers. According to one example, the strategic multi-stacked sections may be selected to protect vital organs. For example, the multi-stacked ballistic layers may be situated to protect vital organs located in the mid-section or upper body such as the head, heart, lungs, abdomen, or the like. According to one example, the multi-piece ballistic shield 100 may include strategic sections that include triple stacked ballistic layers. For example, a first layer may be defined by the first shield portion 102, a second layer may be defined by the upper and lower second layers 107,110, and a third layer may be defined by the second shield portion 104. According to one example, air gaps may be provided between stacked or adjacent ballistic layers. Accordingly, two air gaps may be provided for triple stacked ballistic layers. One of ordinary skill in the art will readily appreciate that a greater number or a fewer number of stacked ballistic layers may be employed. Furthermore, one of ordinary skill in the art will readily appreciate that air gaps may be omitted between stacked ballistic layers.

FIG. 2 illustrates a back view of the multi-piece ballistic shield 100 with the first and second shield portions 102,104 according to one example of the technology. According to one example, the first shield portion 102 may include a handle mechanism 210 that is mechanically coupled to the large rectangular section 103 in an area proximate to the small rectangular section 105. For example, the handle mechanism 210 may be mechanically coupled to the large rectangular section 103 using fasteners 212 such as screws, bolts, rivets, or the like. According to one example, the handle mechanism 210 may directly abut the first shield portion 102. According to one example, the handle mechanism 210 may include a grip. According to one example, the handle mechanism 210 may pivot at a base 214 to fixedly secure the handle mechanism 210 in one of various positions.

For example, FIG. 2 illustrates the handle mechanism 210 fixedly secured in a rightward position. According to one example, the handle mechanism 210 may pivot at the base 214 to fixedly secure the handle mechanism 210 in a substantially perpendicular orientation relative to the first shield portion 102. Furthermore, the handle mechanism 210 may pivot at the base 214 to fixedly secure the handle mechanism 210 in a leftward position. Still further, the handle mechanism 210 may pivot at the base 214 to fixedly secure the handle mechanism 210 in any desired position. According to one example, a fastener 216 may be secured to the handle mechanism 210. For example, the fastener 216 may be secured to the handle mechanism 210 in order to secure a harness thereto as described below. According to one example, the fastener 216 may include a ring or the like. One of ordinary skill in the art will readily appreciate that the handle mechanism 210 may be provided at the opposite side of the base 214 to accommodate left-handed or right-handed users.

According to one example, the second shield portion 104 may include a handle mechanism 220 that is mechanically coupled thereto. For example, the handle mechanism 220 may be mechanically coupled to the second shield portion 104 using fasteners 222 such as screws, bolts, rivets, or the like. According to one example, the handle mechanism 220 may directly abut the second shield portion 104. According to one example, the handle mechanism 220 may include a grip. According to one example, the handle mechanism 220 may pivot at a base 224 to fixedly secure the handle mechanism 220 in one of various positions. For example, FIG. 3 illustrates the handle mechanism 220 fixedly secured in a leftward position. According to one example, the handle mechanism 220 may pivot at the base 224 to fixedly secure the handle mechanism 220 in a substantially perpendicular orientation relative to the second shield portion 102. Furthermore, the handle mechanism 220 may pivot at the base 224 to fixedly secure the handle mechanism 220 in a different position. Still further, the handle mechanism 220 may pivot at the base 224 to fixedly secure the handle mechanism 220 in any position between the rightward and leftward positions. Still further, a handle mechanism may be added to the fastening mechanism 204*a* for left-handed users. One of ordinary skill in the art will readily appreciate that the handle mechanism 220 may be inverted such that the handle mechanism 220 is directed downward rather than upward as depicted in FIG. 4.

According to one example, hook and loop patches 117*b*, 117*c* may be provided on the second shield portion 104. For example, the hook and loop patches 117*b*,117*c* may be provided on an inward face of the second shield portion 104. According to one example, risers 302 may be stacked on the hook and loop patches 117*b*,117*c* to elevate a contact point relative to a surface of the second shield portion 104. For example, the risers 302 maybe stacked on the hook and loop patches 117*b*,117*c* to elevate the contact point such that a user's body part may comfortably engage the second shield portion 104 during use. Still further, the risers 302 may provide padding to users.

Figure 7:
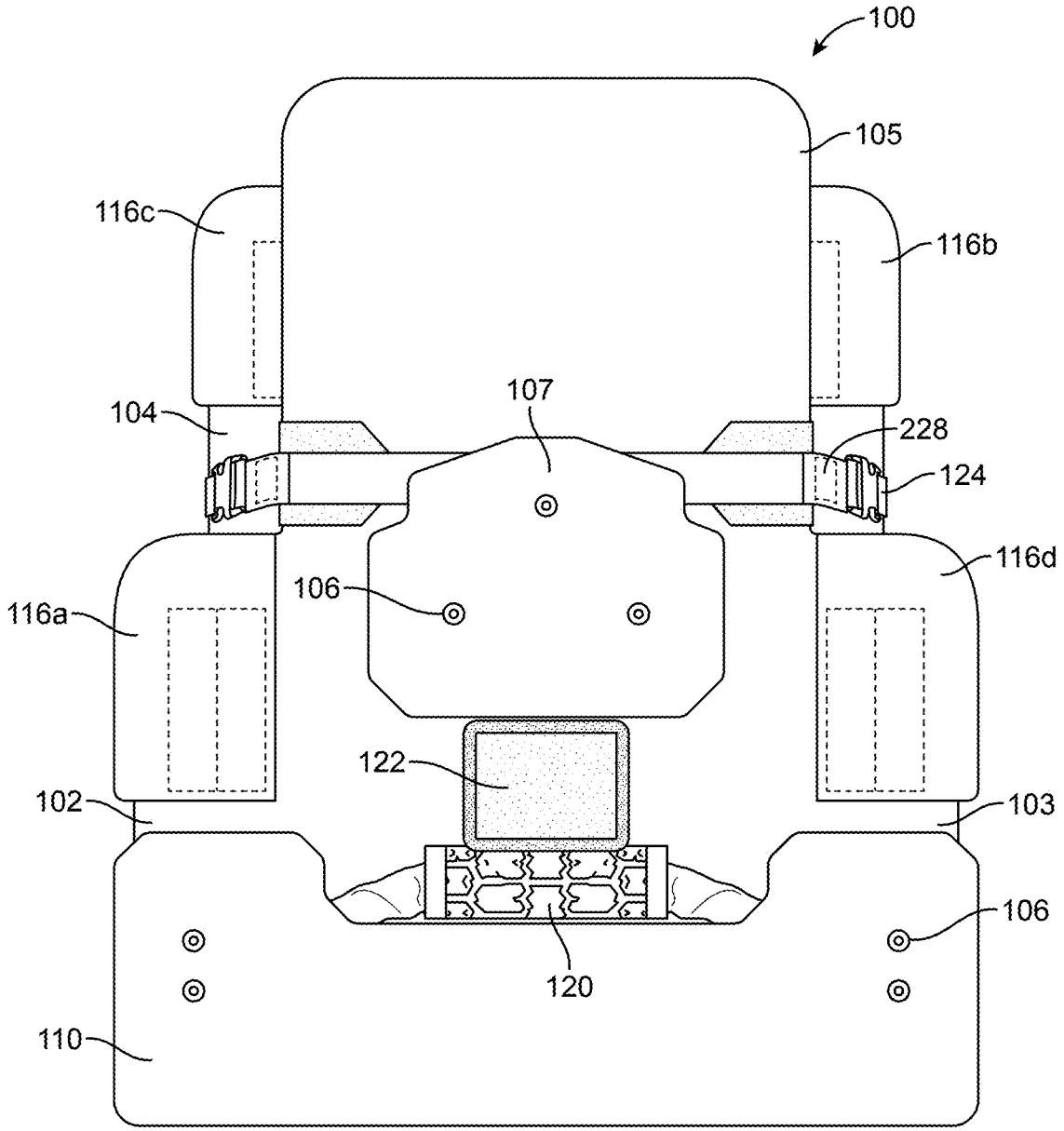
FIG. 7 illustrates the multi-piece ballistic shield with the first and second shield portions being mechanically coupled in a compact configuration for transport according to one example of the technology.

According to one example, FIG. 7 illustrates the multi-piece ballistic shield 100 in a folded arrangement for transport. According to one example, the fastening mechanisms 204*a*,204*b* may be actuated to fold the first shield portion 102 and the second shield portion 104 along the seam 202. In the folded arrangement, the fastening mechanisms 204*a*, 204*b* and the corresponding anchors 206*a*,206*b* secure a first edge of the first and second shield portions 102,104, while straps 124,228 secure a second area of the first and second shield portions 102,104. Accordingly, the multi-piece ballistic shield 100 is configured to occupy minimal space for transport situation. For example, the folded multi-piece ballistic shield 100 may be transported in a backpack or other compact travel bag.

Figure 8:
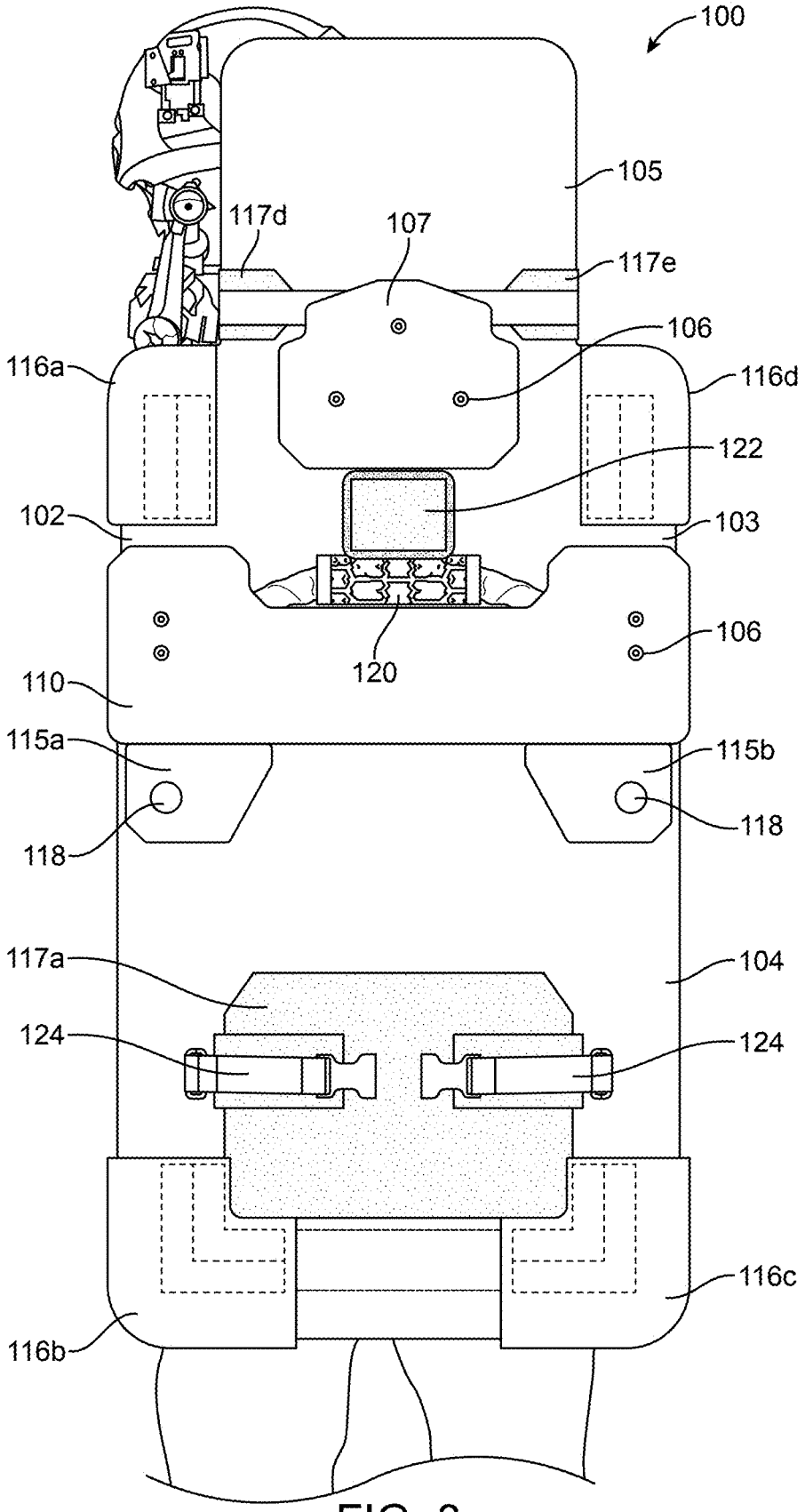
FIG. 8 illustrates a front view of the multi-piece ballistic shield in use according to one example of the technology.

According to one example, the multi-piece ballistic shield 100 may include a fastener 216 that may be mounted to the handle mechanism 210 as illustrated in FIG. 2. According to one example, a harness secured to a vest shoulder strap clips to the fastener 216 to support a majority of the weight attributed to the multi-piece ballistic shield 100. According to one example, the user may rest a firearm on the pad 116*a* of the multi-piece ballistic shield 100 as illustrated in FIG. 8. According to one example, the user may grasp the handle mechanism 220 with a free hand to maneuver the multi-piece ballistic shield 100. For example, the user may maneuver the multi-piece ballistic shield 100 to position the firearm a comfortable distance from the body. According to one example, a comfortable distance may allow the user to aim and discharge the firearm 504 with desired accuracy. One of ordinary skill in the art will readily appreciate that a user may be left-handed and thus may rest the firearm 504 on the pad 116*d* of the multi-piece ballistic shield 100. In this case, the user may grasp the handle mechanism 220 with a right hand to maneuver the multi-piece ballistic shield 100 a comfortable distance from the body to aim and discharge the firearm 504 with desired accuracy. FIG. 8 illustrates a front view of the multi-piece ballistic shield 100 in use according to one example of the technology, with the second shield portion 104 mounted on the first shield portion 102.

FIG. 9 illustrates a front view of the first shield portion 102 in use according to one example of the technology. According to one example, the first shield portion 102 may be deployed in situations of limited physical space. For example, the first shield portion 102 may be deployed in situations where a fugitive enters an attic or other tight space. According to one example, the user may pursue a suspect with the multi-piece ballistic shield 100 and may detach the first shield portion 102 from the second shield portion 104 when warranted by combat conditions. When the user transitions to the first shield portion 102, the user also may transition to a pistol 702 for close quarter combat. In a similar way, users may deploy the second shield portion 104 in situations of limited physical space. Furthermore, users may carry a compact, folded multi-piece ballistic shield 100 and may split the first and second shield portions 102,104 to provide one portion to a comrade during combat such that both are protected by shields.

According to one example, the first and second shield portions 102,104, along with second layers 115*a*,115*b* and the upper and lower second layers 107,110 may be constructed from ultra-high-molecular-weight polyethylene ("UHMWPE"). UHMWPE is a subset of thermoplastic polyethylene and has extremely long chains that transfer load more effectively to the polymer backbone by strengthening intermolecular interactions. This results in a very tough material, with the highest impact strength of any thermoplastic polyethylene. For personal armor, the fibers may be aligned and bonded into sheets that are layered at various angles to give the resulting composite material strength in all directions. A completed multi-piece ballistic shield 100 may include a range of layer counts and layer thicknesses, both for individual layers and a total finished product. According to one example, the thickness of the finished product may depend upon the desired ballistic capabilities and the type of raw ballistic material employed. Generally, for rifle threats, a total product thickness may range from 5 millimeters to 15 millimeters thick and may vary from 60 layers to 120 layers thick. One of ordinary skill in the art will readily appreciate that total product thickness and the layer count may be less for handgun threats. According to one example, the first shield portion 102 may be constructed from 100 ply sheets or greater. According to one example, the second shield portion 104, the second layers 115*a*,115*b*, and upper and lower second layers 107,110 may be constructed from 90 ply sheets or greater. According to one example, the multi-layer ballistic shield 100 improves ballistic strength and a weight or density to performance ratio. According to one example, the multi-stacked layers and configuration of the multi-piece ballistic shield 100 described herein allow it to defeat 5.56×45 mm M855 green tip rounds.

Figure 10:
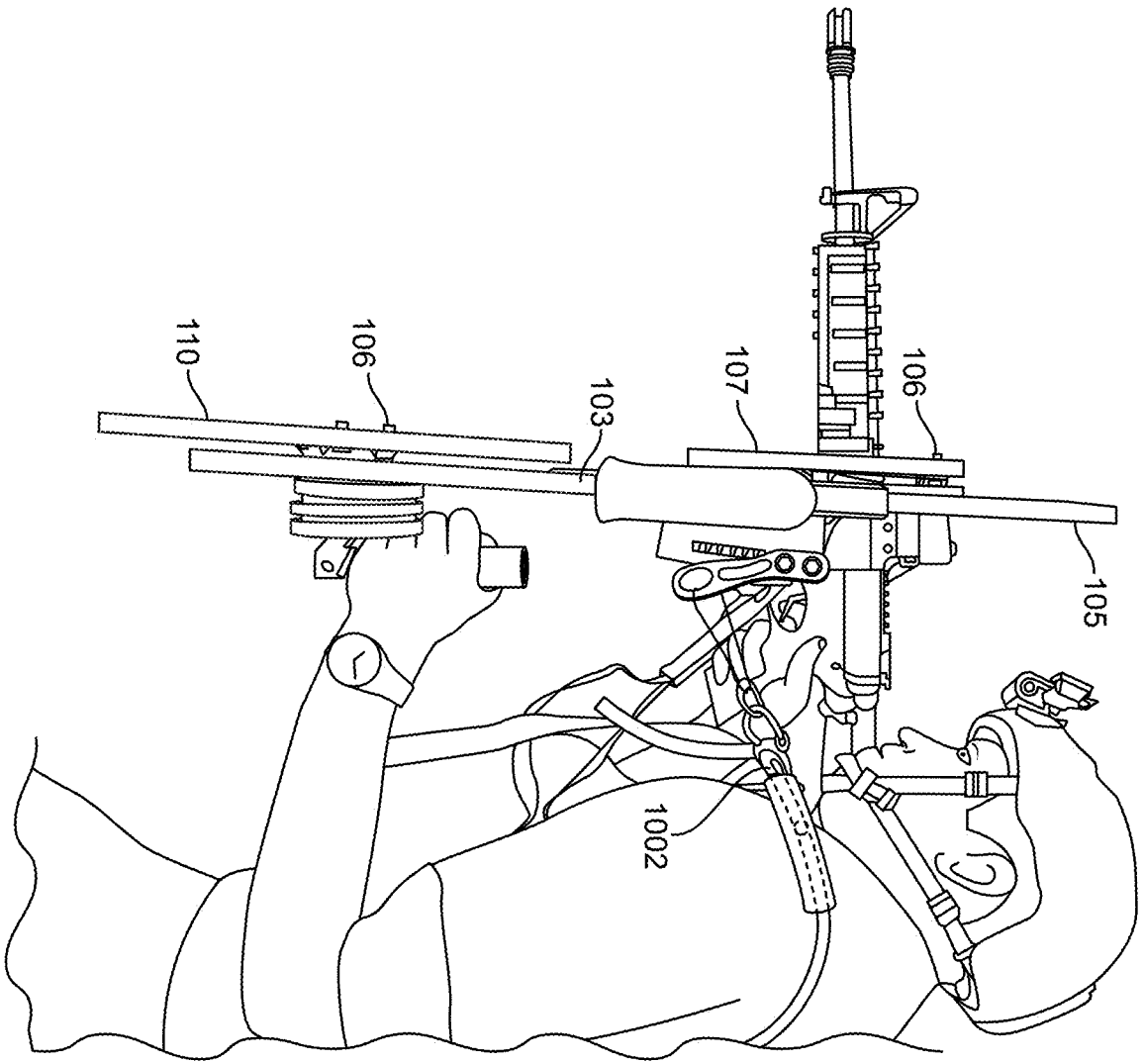
FIG. 10 illustrates a side view of the multi-piece ballistic shield in use, according to one example of the technology

FIG. 10 illustrates a side view of the primary shield portion 105 in use and secured to a user through a harness 1002 according to one example of the technology. According to one example, a user attaches the harness 1002 to a fastener 216 such that the harness 1002 bears the weight of the primary shield portion 105 during use. According to one example, the harness 1002 and the fastener 216 allow the user to employ his hands when carrying the primary shield portion 105. According to one example, the user may employ one hand to guide the primary shield portion 105 and the other hand to carry an object such as a firearm or the like. For example, the user may employ the handle mechanism 210 to guide the primary shield portion 105.

Figure 11:
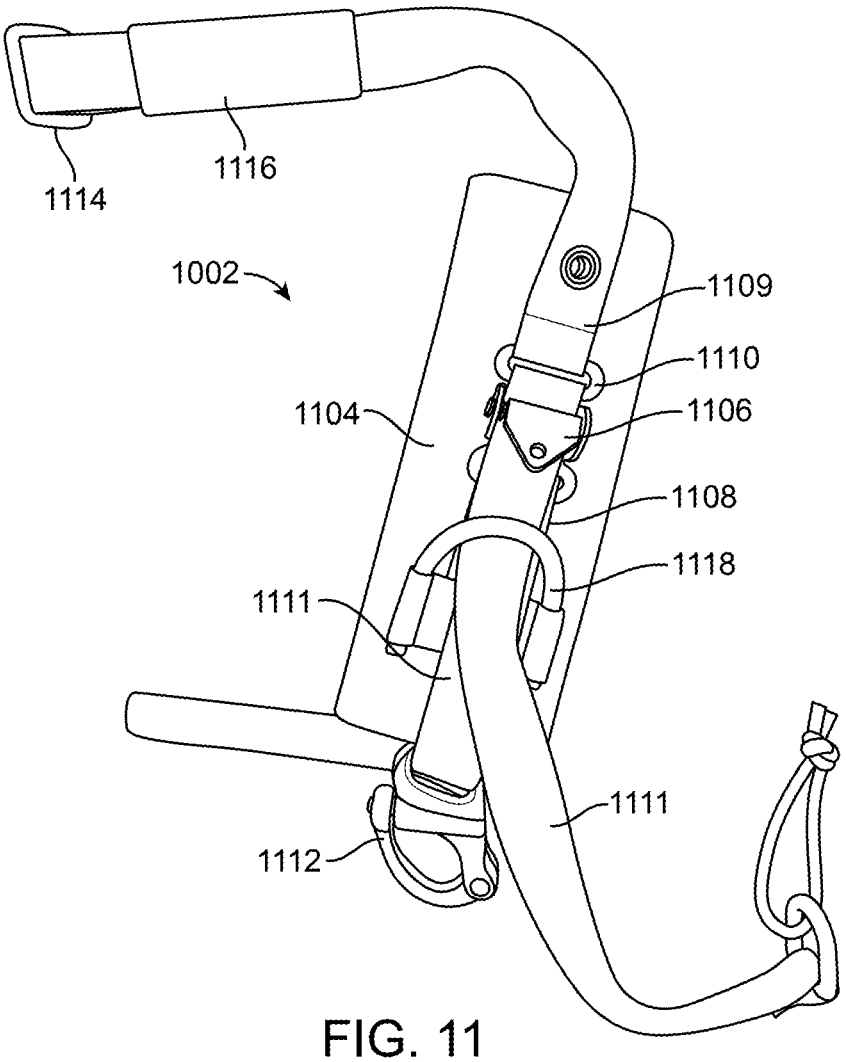
FIG. 11 illustrates a front view of a harness that secures a ballistic shield to a user according to one example of the technology.
Figure 12:
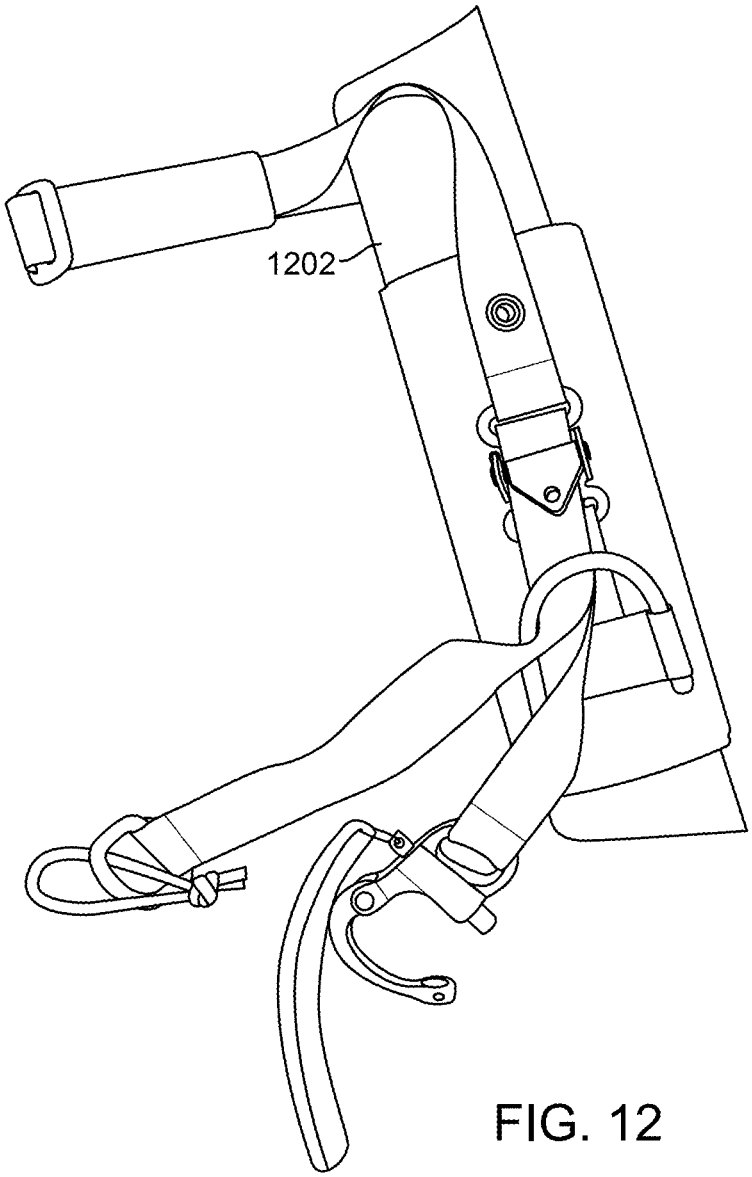
FIG. 12 illustrates a front view of a harness provided around a strap, the harness being configured to secure a ballistic shield to a user according to one example of the technology.
Figure 13:
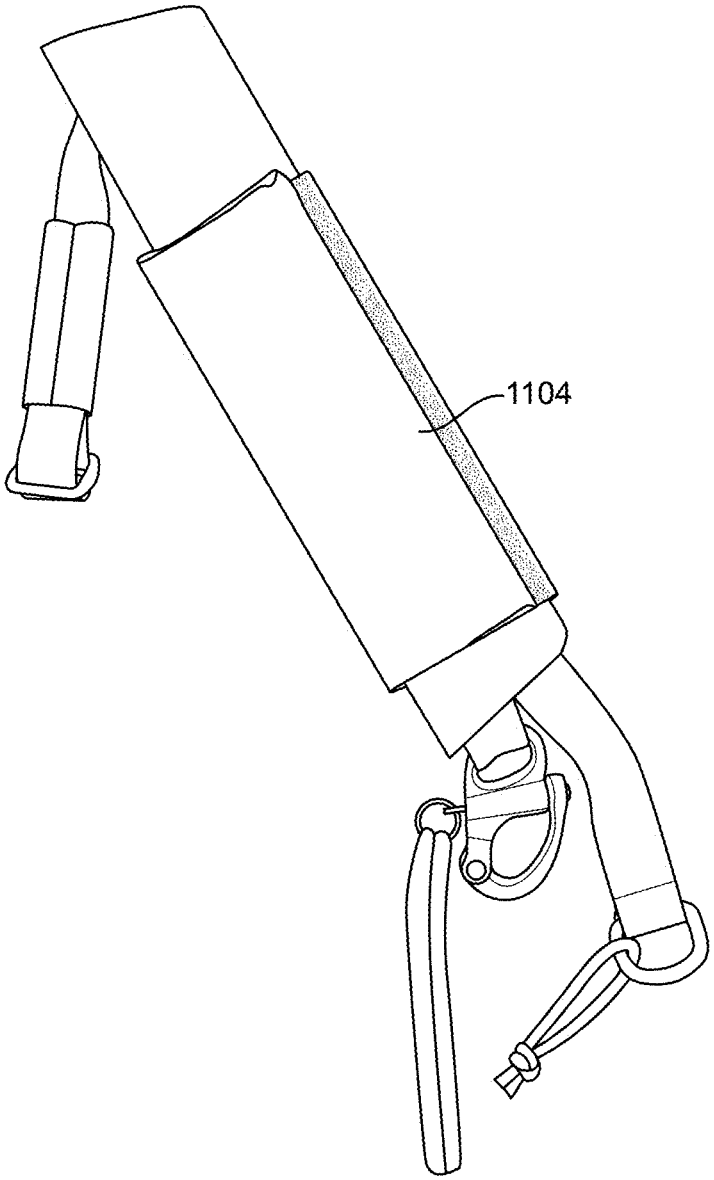
FIG. 13 illustrates a back view of a harness provided around a strap, the harness being configured to secure a ballistic shield to a user according to one example of the technology.
Figure 14:
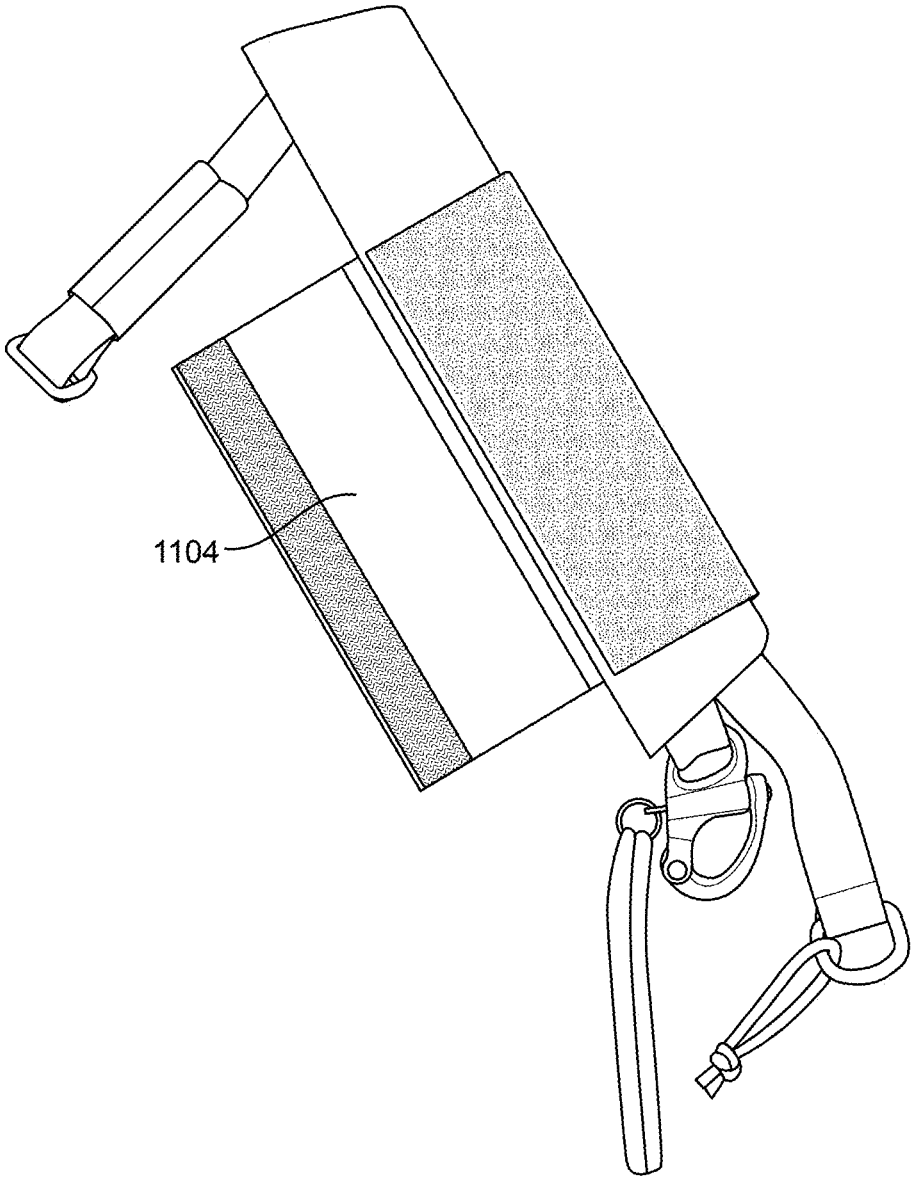
FIG. 14 illustrates a back view of a harness in a partially open configuration and provided around a strap, the harness being configured to secure a ballistic shield to a user according to one example of the technology.

FIG. 11 illustrates a front view of the harness 1002 according to one example of the technology. According to one example, the harness 1002 may include a main body 1104. According to one example, the harness 1002 may include a cam buckle 1106 that is secured to the main body 1104 using straps such as woven straps. According to one example, the cam buckle 1106 may be secured to the main body 1104 using an attaching strap 1108 and an anchor strap 1109. For example, the attaching and anchor straps 1108, 1109 may be secured to the main body 1104 via stitching or the like. According to one example, the securing and anchor straps 1108,1109 may be secured together using a strap ring 1010. According to one example, an adjustment strap 1111 may be provided through the cam buckle 1106 to allow a user to adjust a carrying distance between the harness 1002 and the multi-layer ballistic shield 100. According to one example, the adjustment strap 1111 may include a snap shackle 1112 that is mechanically coupled to the shield fastener 216 during use. According to one example, the anchor strap 1109 may be secured to MOLLE webbing or a pouch attachment ladder system (PALS) worn by the user. For example, the anchor strap 1109 may be secured to MOLLE webbing or the PALS using a buckle 1114. According to one example, a sheath 1116 may be slipped over the buckle 1114 to minimize slipping of the anchor strap 1109 in the buckle 1114. According to one example, the harness 1002 may include a guide 1118 that minimizes lateral movement of the adjustment strap 1111 during use. FIG. 12 illustrates the harness 1002 secured around an object 1202 that a user may wear on his upper body to support the multi-layer ballistic shield 100. FIG. 13 illustrates a back view of the harness 1002. FIG. 14 illustrates a back view of the harness 1002 with the main body 1104 partially opened. According to one example, the main body 1104 may include a tri-fold structure that employs a hook and loop fastening mechanism.

While the foregoing illustrates and describes examples of this technology, it is to be understood that the technology is not limited to the constructions disclosed herein. The technology may be embodied in other specific forms without departing from its spirit. Accordingly, the appended claims are not limited by specific examples described herein.

What is claimed is:

1. A multi-piece ballistic shield, comprising:

a first shield having an outward face exposed to projectiles and an opposing inward face, the first shield comprising:

a first offset layer that is mechanically coupled to a first section of the outward face of the first shield, the first offset layer being offset by an air gap from the first shield; and a second offset layer that is mechanically coupled to a second section of the outward face of the first shield; and a second shield having an outward face exposed to projectiles and an opposing inward face, the second shield being detachably coupled to the first shield and including a second layer aligned with and size dimensioned similar to a corresponding fastening mechanism provided on the inward face, wherein the second offset layer overlaps a seam formed between the first and second shields.

2. The multi-piece ballistic shield according to claim 1, wherein the second shield folds onto the first shield.

3. The multi-piece ballistic shield according to claim 2, further comprising fastening mechanisms and corresponding anchors that allow the second shield to fold onto the first shield.

4. The multi-piece ballistic shield according to claim 1, wherein the first section is dimensioned to protect a human head and the second section is dimensioned to protect a human torso.

5. The multi-piece ballistic shield according to claim 1, wherein the second offset layer is offset by an air gap from the first shield.

6. The multi-piece ballistic shield according to claim 1, further comprising three or more stacked layers.

7. The multi-piece ballistic shield according to claim 1, further comprising a first handle mechanism mechanically coupled to the inward face of the first shield, the first handle mechanism having a first arm that pivots at a base to fixedly secure a first grip in one of various positions.

8. The multi-piece ballistic shield according to claim 1, further comprising a second handle mechanism mechanically coupled to the inward face of the second shield, the second handle mechanism having a second arm that pivots at a base to fixedly secure a second grip in one of various positions.

9. The multi-piece ballistic shield according to claim 1, wherein at least one of the first shield, the first offset layer, the second offset layer, or the second shield are constructed from ultra-high-molecular-weight polyethylene.

10. A multi-piece ballistic shield, comprising: a first shield having an outward face exposed to projectiles and an opposing inward face, the first shield comprising: a first offset layer that is mechanically coupled to a first section of the outward face of the first shield, the first offset layer being offset by an air gap from the first shield; a second offset layer that is mechanically coupled to a second section of the outward face of the first shield; a first handle mechanism mechanically coupled to the inward face; and a fastener secured to the first handle mechanism; a second shield having an outward face exposed to projectiles and an opposing inward face, the second shield being detachably coupled to the first shield and including a second layer aligned with and size dimensioned similar to a corresponding fastening mechanism provided on the inward face; and a harness coupled to the fastener to support a weight of the multi-piece ballistic shield.

11. The multi-piece ballistic shield according to claim 10, wherein the second shield folds onto the first shield and the second offset layer overlaps a seam formed between the first and second shields.

12. The multi-piece ballistic shield according to claim 10, wherein the first section is dimensioned to protect a human head and the second section is dimensioned to protect a human torso.

13. The multi-piece ballistic shield according to claim 10, wherein the second offset layer is offset by an air gap from the first shield.

14. The multi-piece ballistic shield according to claim 10, further comprising fastening mechanisms and corresponding anchors that allow the second shield to fold onto the first shield.

15. The multi-piece ballistic shield according to claim 10, further comprising three or more stacked layers.

16. The multi-piece ballistic shield according to claim 10, wherein the first handle mechanism includes a first arm that pivots at a base to fixedly secure a first grip in one of various positions.

17. The multi-piece ballistic shield according to claim 10, further comprising a second handle mechanism mechanically coupled to the inward face of the second shield, the second handle mechanism having a second arm that pivots at a base to fixedly secure a second grip in one of various positions.

18. The system according to claim 10, wherein at least one of the first shield, the first offset layer, the second offset layer, or the second shield are constructed from ultra-high-molecular-weight polyethylene.

19. A multi-piece ballistic shield, comprising: a first shield having an outward face exposed to projectiles and an opposing inward face, the first shield comprising: a first offset layer that is mechanically coupled to a first section of the outward face of the first shield; and a second offset layer that is mechanically coupled to a second section of the outward face of the first shield, the second offset layer being offset by an air gap from the first shield; and a second shield having an outward face exposed to projectiles and an opposing inward face, the second shield being detachably coupled to the first shield and including a second layer aligned with and size dimensioned similar to a corresponding fastening mechanism provided on the inward face, wherein the second offset layer overlaps a seam formed between the first and second shields.

20. A multi-piece ballistic shield, comprising: a first shield having an outward face exposed to projectiles and an opposing inward face, the first shield comprising: a first offset layer that is mechanically coupled to a first section of the outward face of the first shield; a second offset layer that is mechanically coupled to a second section of the outward face of the first shield, the second offset layer being offset by an air gap from the first shield; a first handle mechanism mechanically coupled to the inward face; and a fastener secured to the first handle mechanism; a second shield having an outward face exposed to projectiles and an opposing inward face, the second shield being detachably coupled to the first shield and including a second layer aligned with and size dimensioned similar to a corresponding fastening mechanism provided on the inward face; and a harness coupled to the fastener to support a weight of the multi-piece ballistic shield.

* * * * *